United States Patent [19]

Rich

[11] 4,224,550

[45] Sep. 23, 1980

[54] VACUUM DISCHARGE DEVICE WITH ROD ELECTRODE ARRAY

[75] Inventor: Joseph A. Rich, Schenectady, N.Y.

[73] Assignee: Electric Power Research Institute, Inc., Palo Alto, Calif.

[21] Appl. No.: 14,352

[22] Filed: Feb. 23, 1979

[51] Int. Cl.[2] ..... H01H 33/66; H01J 21/22

[52] U.S. Cl. ..... 313/146; 200/144 B; 313/174; 313/198; 313/217; 313/233

[58] Field of Search ..... 313/217, 146, 233, 147, 313/307, 174, 198; 200/144 B

[56] References Cited

U.S. PATENT DOCUMENTS

| | | | |
|---|---|---|---|
| 3,679,474 | 7/1972 | Rich | 313/217 |
| 3,798,484 | 3/1974 | Rich | 313/217 X |
| 4,063,126 | 12/1977 | Rich et al. | 313/146 |
| 4,086,459 | 4/1978 | Rich | 200/144 B |

OTHER PUBLICATIONS

"Triggered Vacuum Gaps," by J. M. Lafferty, *Proc. IEEE*, vol. 54, No. 1, Jan. 1966, pp. 23–32.

"Low Voltage Firing Characteristics of a Triggered Vacuum Gap," by George A. Farrall, *IEEE Transactions on Electronic Devices*, vol. ED-13, No. 4, Apr. 1966, pp. 432–438.

*Primary Examiner*—Palmer C. Demeo

*Attorney, Agent, or Firm*—Flehr, Hohbach, Test, Albritton & Herbert

[57] ABSTRACT

In a rod array vacuum arc device, conductive protuberances are positioned on the conductive rod support plates. The protuberances positioned on each plate are aligned axially with the opposed rod electrodes. The protuberances increase the dielectric strength of the gap between each plate and the opposed electrode.

8 Claims, 3 Drawing Figures

VACUUM DISCHARGE DEVICE WITH ROD ELECTRODE ARRAY

The present invention relates generally to vacuum arc devices which operate at high currents and which incorporate rod array arcing surfaces.

Vacuum devices employing rod arrays are used as circuit protection devices where large arcing surfaces are desirable. Examples of prior art vacuum devices employing rod arrays are found in Rich, U.S. Pat. Nos. 3,679,474 and 3,798,484, and Rich et al, U.S. Pat. No. 4,063,126. Whether used in vacuum switches or triggered vacuum gap devices, rod arrays afford large arcing surfaces which prevent the formation of destructive anode spots and permit rapid dielectric recovery.

An important design consideration in all vacuum arc devices is the strengthening of the various gaps with regard to their ability to hold off voltage. In alternating current devices, it is additionally desirable to avoid polaritysensitive gaps. One particularly weak gap found in rod array devices is the rod-plate gap present between each rod and the nearest end plate having the opposite polarity. Such rod-plate gaps are not only inherently weak but are also polarity-sensitive, exhibiting the lowest breakdown voltage when the rod is the cathode and the plate is the anode. Typical rod array devices include at least one rod-plate gap of each polarity orientation. A weak gap is therefore present regardless of the polarity of the arc current. As noted above, it is desirable to avoid all weak and polarity sensitive gaps in rod array devices.

It is the general object of the present invention to provide a rod array vacuum arc device with increased ability to hold off voltage.

Another object of the invention is to provide a rod array vacuum arc device in which individual gaps exhibit a reduced sensitivity to polarity change.

Another object of the invention is to provide a rod array vacuum arc device in which all rod-plate gaps are effectively eliminated.

Accordingly, a vacuum arc device is provided which includes a sealed enclosure having an evacuated chamber therein, with first and second conductive plates at opposite ends of the chamber. A plurality of first rod electrodes are supported from the first conductive plate, and a plurality of second rod electrodes are supported from the second conductive plate within the chamber. The first and second rod electrodes are in a spaced side by side relation to provide arcing surfaces. Means are provided for initiating arcing between the first and second rod electrodes. A plurality of conductive protuberances are provided on the interior surface of the first and second conductive plates. The protuberances on the first conductive plate are aligned axially with the second rod electrodes, and the protuberances on the second conductive plate are aligned axially with the first rod electrodes. The protuberances define the dielectric gaps between each of the rod electrodes and the opposite conductive plate.

A preferred embodiment of the invention is described in detail below with reference being made to the accompanying drawings, in which.

Figure 1:
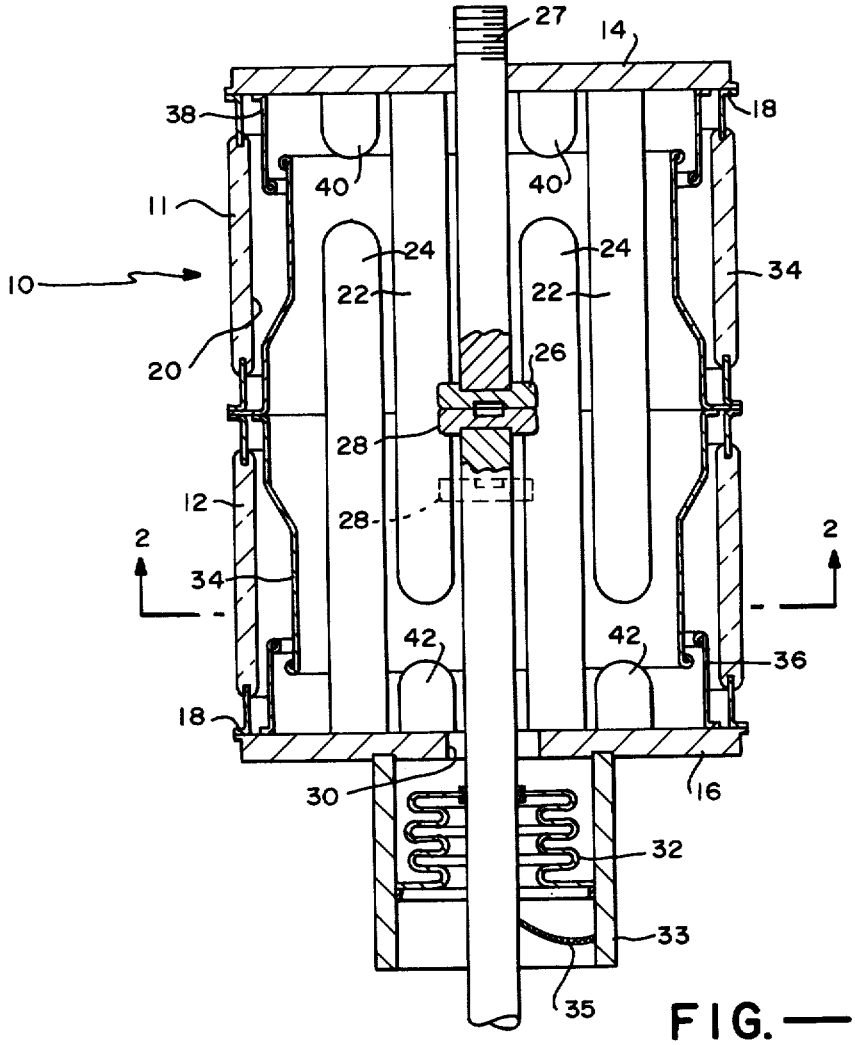
FIG. 1 is a cross-sectional view of a vacuum arc device in accordance with the present invention.

Referring to FIG. 1, a first embodiment of a vacuum arc device in accordance with the present invention is a rod array vacuum interrupter of the type employing separable electrodes. This embodiment includes a sealed enclosure 10 defined by cylindrical insulating side wall members 11 and 12 formed of glass or a suitable ceramic material. The ends of the enclosure are closed by a pair of conductive plates 14 and 16. The plates are sealed in any suitable manner to side walls 11 and 12 by seals 18. The interior chamber 20 within enclosure 10 is evacuated, preferably to a pressure of approximately $10^{-5}$ torr or less.

Figure 2:
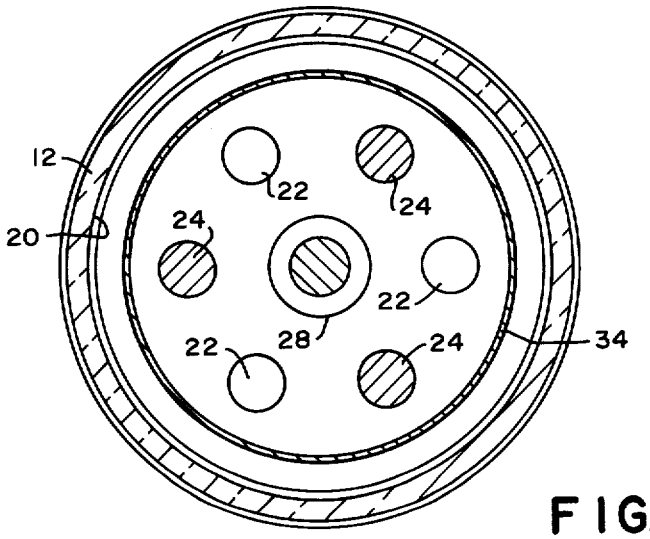
FIG. 2 is a horizontal sectional view taken along line 2—2 of FIG. 1.

Within enclosure 10 are a plurality of rod electrodes supported from the conductive plates 14 and 16 at the opposite ends of chamber 20. Plate 14 is referred to herein as the first conductive plate, and a plurality of first rod electrodes 22 are supported from plate 14. Plate 16 is referred to herein as the second conductive plate and a plurality of second rod electrodes 24 are supported from plate 16. Rod electrodes 22 and 24 extend into spaced side by side relation to provide arcing surfaces therebetween. Preferably, electrodes 22 and 24 are arranged in circular arrays, and form a ring of alternating spaced electrodes, as shown in FIG. 2.

Also within enclosure 10 are a pair of relatively movable electrodes 26 and 28. Electrodes 26 and 28 are movable between a closed position, shown with solid lines in FIG. 1, in which the electrodes are in mutual contact, and an open position as shown in phantom in FIG. 1. In the preferred embodiment, electrode 26 is supported in a fixed position from conductive plate 14, with a terminal connector 27 being provided at the outer end. Electrode 28 extends through an opening 30 in conductive plate 16. A metal bellows 32 sealed to electrode 28 and also sealed to an external protective bellows support 33 allows movement without disruption of the interior vacuum in enclosure 10. The bellows support is formed of conductive metal in the preferred embodiment and serves as a lower connection terminal for the interrupter. Braided wire 35 interconnects terminal 33 and electrode 28. Also supported in the enclosure are suitable metal vapor shields 34, 36 and 38 which protect insulating parts of the enclosure from metallic deposits generated during arcing.

Rod electrodes 22 and 24 are formed of any suitable vacuum arc electrode material, preferably one which is substantially gas free. Copper, particularly if internally reinforced to give additional mechanical strength, is a suitable metal for the rod electrodes. The rod electrodes should be smooth surfaced and have rounded ends. The ends can be substantially hemispherical, for example. The circular arrangement of the rod electrode arrays is in accordance with U.S. Pat. No. 3,679,474, although other arrangements for the rod electrodes are possible within the scope of the present invention.

In cooperation with the rod electrodes in enclosure 10, a plurality of conductive protuberances are provided on the interior surfaces of conductive plates 14 and 16. The protuberances 40 on first conductive plate 14 are aligned axially with rod electrodes 24 extending from conductive plate 16. Protuberances 42 on second conductive plate 16 are aligned axially with the rod electrodes 22 extending from plate 14. The protuberances being aligned axially means that each protuberance is positioned approximately centrally on the axis of the nearest of the oppositely-extending rod electrodes. Protuberances 40 and 42 may be formed of the same material as are rod electrodes 22 and 24, or of any other suitable conductive material. The protuberances preferably are substantially cylindrical rod-shaped members of approximately the same diameter as the rod electrodes, but considerably shorter. A rounded end is preferably provided facing the rod electrode to substantially match the end of the electrode. The ends of the protuberances may be substantially hemispherical, for example. The protuberances define the dielectric gaps between each rod electrode and the opposite conductive plate.

In operation, the first embodiment vacuum arc device shown in FIG. 1 will be installed between terminals of a power line or the like (not shown). One power line connection is made to connector 27 which is electrically connected to conductive plate 14, and the other connection is made to terminal 33 which is connected to conductive plate 16 and movable electrode 28. The first embodiment vacuum arc device can then be operated as a current interrupting switch. With the electrodes closed, current flows freely through the device between electrodes 26 and 28. When circuit isolation is called for, electrode 28 is moved from the closed to the open position by any suitable means. Preferably, a fast acting actuator will be coupled to the exterior end of electrode 28 for this purpose. Following electrode separation, an arc appears between electrodes 26 and 28. The plasma cloud released by the arcing electrodes initiates arcing between adjacent rod electrodes within chamber 20. Assuming the device is being used to interrupt an alternating current, arcing will continue until a normal current zero in the alternating current cycle. If the dielectric strength between the various gaps in the device is sufficient, arc reignition will be prevented and current interruption will be complete.

The provision of protuberances 40 and 42 on the interior surfaces of conductive plates 14 and 16 considerably strengthens the gaps between the rod electrodes and the opposite conductive plates. This is because a rod-rod gap is inherently stronger than a rod-plane (or rod-plate) gap. In essence, a rod-rod gap is a sphere-sphere gap. For a given minimum separation and spherical radius, it is known that a sphere-sphere gap is substantially stronger than a sphere-plane gap. The present invention eliminates rod-plane (i.e. sphere-plane) gaps from rod array vacuum devices. As noted in the background above, rod-rod gaps are also polarity insensitive, and therefore the elimination of such gaps is especially advantageous in alternating current devices.

Figure 3:
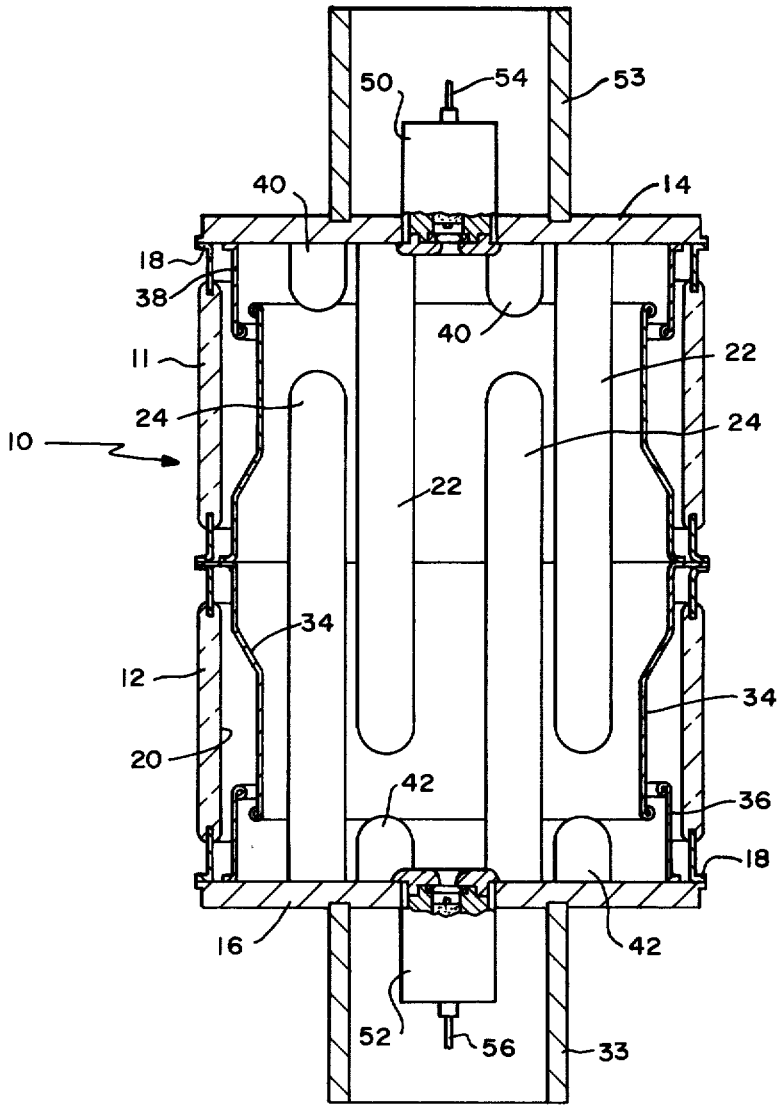
FIG. 3 is a cross-sectional view of an alternative embodiment of a vacuum device in accordance with the present invention.

An alternative embodiment of the present invention is shown in FIG. 3. The embodiment of FIG. 3 has essentially the same construction as the first embodiment, with like reference numbers being used to designate like components in the two embodiments. This embodiment includes an enclosure 10 having an evacuated interior chamber 20 and first and second rod electrodes 22 and 24. First and second conductive plates 14 and 16, respectively, are provided with a plurality of conductive protuberances 40 and 42. As before, the protuberances are aligned axially with the rod electrodes extending from the opposite conductive plate.

Unlike the first embodiment, the embodiment of FIG. 3 includes plasma trigger means 50 and 52 instead of movable electrodes 26 and 28 as means for initiating arcing. Arc initiating plasma triggers 50 and 52 extend through and arc sealed to conductive plates 14 and 16, respectively. An enclosing metal terminal 33 is provided on plate 16 and encloses trigger 52, and a similar terminal 53 is provided on plate 14 to protect trigger 50. Terminals 33 and 53 serve as connection terminals for the interrupter of FIG. 3. Plasma triggers 50 and 52 can be of any conventional type, for example the triggers disclosed in detail in Lafferty, U.S. Pat. No. 3,465,192. The respective anode leads 54 and 56 of triggers 50 and 52, respectively, are electrically connected to a common firing circuit (not shown) to ensure they both receive a trigger pulse simultaneously. When fired, triggers 50 and 52 release an arc triggering plasma into chamber 20.

In operation, the embodiment of FIG. 3 is connected to circuit terminals of opposite polarity (not shown), with one circuit connection being made to terminal 53 and the other being made to terminal 33. The device is not conductive until triggered. If the device is to be triggered into conduction due to an overload condition, for example, a trigger pulse is sent to triggers 50 and 52 over anode leads 54 and 56, respectively. Under alternating current operation, the pulse source will fire whichever plasma trigger is the one with its anode lead positive with respect to the conductive plate to which it is attached. When the plasma trigger fires, an electron-ion plasma is injected into chamber 20, immediately triggering an arc between each pair of adjacent rod electrodes 22 and 24. If sufficient voltage is present between conductive plates 14 and 16, arcing creates an almost instantaneous short-circuit. In the next naturally-occurring current zero in the alternating current cycle, the arc is extinguished and will not reignite unless again triggered by one of the plasma triggers.

As in the first embodiment, the presence of protuberances 40 and 42 increases the voltage withstand ability of the vacuum devices. Both the strength and symmetry of the gap between each rod electrode and the opposite conductive plate is increased. The weaker and more polarized rod-plane gaps are eliminated.

The present invention achieves an increase in device holdoff voltage at relatively little cost. The only cost of any significance associated with the addition of protuberances to a rod array device is the need to lengthen the enclosure slightly to maintain the same total arcing surface between adjacent rod electrodes. However, an increase in the length of the cylindrical vacuum enclosure is comparatively inexpensive, particularly relative to the high cost of increasing the enclosure diameter. Alternatively, enclosure size can be maintained and the total arcing surface reduced by shortening the rod electrodes.

Although protuberances 40 and 42 have been illustrated in the Figures as being relatively short rods having essentially the same diameter as the rod electrodes, alternative shapes are possible within the scope of the invention. The protuberances could be lenghthened or shortened to achieve particular design requirements, for example. The protuberances could be more or less spherical, if such a shape proves optimum in particular applications. Neither the ends of the rods nor the ends of the protuberances need be a spherical contour, but could instead assume other shapes. Protuberances in accordance with the present invention could also be installed in other rod array devices such as the device employing "bulbous" rods disclosed in Rich et al, U.S. Pat. No. 4,063,126. Similarly, the protuberances could be installed on the conductive walls of individual chambers in rod array devices incorporating a plurality of chambers. Examples of devices having more than one chamber are found in Rich, U.S. Pat. No. 3,798,484. In such multi-chambered devices, the protuberances would be incorporated into each chamber (regions A and B in U.S. Pat. No. 3,798,484) in the same manner as in the single chamber 20 of the embodiments disclosed herein.

The present invention provides a rod array vacuum arc device having increased ability to hold off voltage. The invention further provides a rod array vacuum arc device in which individual gaps in the device exhibit a reduced sensitivity to polarity changes. The invention also provides a rod array vacuum arc device in which all rod-plate gaps are effectively eliminated.

What is claimed is:

1. A vacuum device comprising: a sealed enclosure having an evacuated chamber therein, first and second conductive plates at opposite ends of said chamber, a plurality of first rod electrodes supported from said first conductive plate and a plurality of second rod electrodes supported from said second conductive plate within said chamber, said first and second rod electrodes extending into spaced side by side relation to provide arcing surfaces, means for initiating arcing between said first and second rod electrodes, and a plurality of conductive protuberances on the interior surface of said first and second conductive plates, said protuberances on said first conductive plate being aligned axially with said second rod electrodes and said protuberances on said second conductive plate being aligned axially with said first rod electrodes whereby said protuberances define the dielectric gaps between each said electrode and the opposite conductive plate.

2. A device as in claim 1 in which said rod electrodes are substantially cylindrical and have smooth outer surfaces and substantially hemispherical ends.

3. A device as in claim 2 in which said protuberances include substantially hemispherical ends facing said hemispherical ends of said rod electrodes.

4. A device as in claim 1 in which said protuberances include short rod-shaped members aligned axially with said rod electrodes, said protuberances being substantially shorter than said rod electrodes.

5. A device as in claim 1 in which said rod electrodes and said protuberances are substantially cylindrical and have rounded ends, said rod electrodes and said protuberances being substantially equal in diameter.

6. A device as in claim 1 in which said means for initiating arcing includes a pair of electrodes movable with respect to one another in said enclosure.

7. A device as in claim 1 in which said means for initiating arcing includes plasma trigger means in said enclosure.

8. A device as in claim 1 in which said first and second rod electrodes are arranged in circular arrays and form a ring of spaced first and second rod electrodes.

* * * * *